United States Patent [19]

Watkins

[11] Patent Number: 4,864,946

[45] Date of Patent: Sep. 12, 1989

[54] YARN FEED SPLIT ROLL APPARATUS FOR TUFTING MACHINE

[75] Inventor: Charles W. Watkins, Ooltewah, Tenn.

[73] Assignee: Tuftco Corporation, Chattanooga, Tenn.

[21] Appl. No.: 274,251

[22] Filed: Nov. 18, 1988

[51] Int. Cl.[4] ..... D05C 15/8

[52] U.S. Cl. ..... 112/80.73

[58] Field of Search ..... 112/80.73, 80.41, 80.24

[56] References Cited

U.S. PATENT DOCUMENTS

| | | | |
|---|---|---|---|
| 2,862,465 | 12/1958 | Card | 112/80.24 |
| 2,966,860 | 1/1961 | Card | 112/80.73 |
| 3,847,098 | 11/1974 | Hammel | 112/80.73 |
| 4,366,761 | 1/1933 | Card | 112/80.41 |
| 4,411,207 | 10/1983 | Brock et al. | 112/80.73 |
| 4,608,935 | 9/1986 | Barsley | 112/80.73 |
| 4,688,497 | 8/1987 | Card et al. | 112/80.73 |

*Primary Examiner*—Ronald Feldbaum

*Attorney, Agent, or Firm*—Harrington A. Lackey

[57] ABSTRACT

A yarn feed mechanism for a multiple needle tufting machine in which a plurality of yarn feed stub rolls are mounted on transversely spaced supports on the machine in such a manner that the stub rolls project in opposite directions from opposite sides of each support and have free ends which are spaced apart from the free ends of adjacent feed rolls to facilitate threading and unthreading the feed rolls. Each yarn feed support carries a plurality of first and second vertically spaced feed rolls on opposite sides of the support and each pair of coaxially aligned feed rolls are driven from a corresponding drive shaft adapted to be driven selectively at a high speed or a low speed. The yarn feed stub roll mechanism is particularly useful in the formation of relatively simple patterns, such as graphic or diamond-shaped patterns with multi-colored yarns such as those previously produced by Wilton Looms, to substantially reduce the down-time in threading and rethreading the yarn feed mechanism for different patterns.

17 Claims, 7 Drawing Sheets

YARN FEED SPLIT ROLL APPARATUS FOR TUFTING MACHINE

BACKGROUND OF THE INVENTION

This invention relates to a yarn feed mechanism for a tufting machine, and more particularly to pattern-controlled yarn feed split or stub rolls for a multiple needle tufting machine.

Pattern controlled yarn feed rolls for multiple needle tufting machines are well known in the art, as illustrated in the following U.S. patents:

| | | |
|---|---|---|
| 2,966,866 | J. L. Card | Jan. 3, 1961 |
| 2,862,465 | J. L. Card | Dec. 2, 1958 |
| 3,847,098 | W. W. Hammel, Jr. | Nov. 12, 1974 |

The J. L. Card U.S. Pat. No. 2,966,866 discloses a bank of four pairs of yarn feed rolls, each pair of which is selectively driven at a high speed or a low speed by the pattern control mechanism. All of the yarn feed rolls extend transversely the entire width of the machine and are journaled at both ends. Accordingly, the threading and unthreading of the respective yarn feed rolls in order to change the characteristics of the yarns, and therefore the patterns, such as the colors, is extremely time-consuming. Each yarn must be pulled back through the corresponding roll pairs from the needles and the yarns rearranged and individually reinserted through the rolls and re-threaded in the needles.

The pattern control yarn feed rolls disclosed in the J. L. Card U.S. Pat. No. 2,862,465 project forward perpendicularly to the transverse row of needles, and each roll, because of its short length, is limited in the amount of yarn that the roll can carry. As a matter of fact, only the number of yarns equal to the repeat patterns are carried on each roll.

The J. L. Card U.S. Pat. No. 2,862,465, further discloses yarn guide tubes for carrying each independent thread from its corresponding yarn feed rolls to the respective needles. Moreover, the plurality of yarn feed tubes from each yarn feed roll span substantially the entire width of the machine so that the arrangement of the yarn feed tubes is rather complicated and expensive to manufacture.

The yarn feed module of the Hammel U.S. Pat. No. 3,847,098 discloses a plurality of pairs of short yarn feed rolls which are mounted to rotate about transverse axes. The rolls are closely spaced together end-to-end, and each roll is designed to carry only a limited number of yarns. Furthermore, each of the modules carries only one pair of feed rolls which project from the same side of the corresponding module.

U.S. Pat. No. 4,366,761 of Roy T. Card, issued Jan. 4, 1983, discloses dual shiftable needle bars for a tufting machine in which each of the needle bars is adapted to be shifted independently of the other needle bar in accordance with a programmed pattern to produce the graphics-type patterns such as those previously produced on Wilton type looms and as disclosed in FIGS. 7 and 8.

Tufting machines incorporating the dual shiftable needle bars as disclosed in the R. T. Card U.S. Pat. No. 4,366,761 have been used in conjunction with pattern-controlled yarn feed mechanisms incorporating a series of four rolls extending the length of the machine, such as those disclosed in the J. L. Card U.S. Pat. No. 2,966,866. The patterned tufted fabrics made by such machines have been favorably accepted where geometrical patterns and graphics designs are desired. However, the threading and re-threading of such four-roll, dual shiftable needle bar tufting machines has resulted in considerable down-time for each pattern change. Depending upon the pattern desired, the threading time for such four-roll machines ranges from 36 to 64 man hours, which substantially adds to the production time and cost of the patterned tufted products.

SUMMARY OF THE INVENTION

It is therefore an object of this invention to provide in a multiple needle tufting machine, a pattern-controlled yarn feed mechanism incorporating transverse yarn feed rolls which are easily threaded and unthreaded.

The yarn feed mechanism made in accordance with this invention includes a plurality of split yarn feed rolls or stub rolls. The foreshortened yarn feed rolls are mounted in split or separated sets upon a plurality of transversely spaced supports on the machine. Each feed roll in each set is driven at a high speed or a low speed by one of a plurality of corresponding long yarn feed drive shafts extending the width of the machine. Each drive shaft is driven selectively by a pattern-controlled electromagnetic high speed clutch or a low speed clutch.

The yarn feed stub rolls made in accordance with this invention may be mounted on transversely spaced supports and disposed transversely on the front and the back of a tufting machine incorporating the dual shiftable needle bars of U.S. Pat. No. 4,366,761 for producing geometric and graphic patterns of the Wilton type, with a minimum of down-time for threading the yarn feed rolls.

The yarn feed stub rolls are designed to be utilized in a multiple needle tufting machine having a multiple number of independent yarn guide devices or yarn tube banks. Each yarn guide device spreads the yarns from a corresponding set of vertically spaced stub rolls over a limited repeat distance, that is to a limited number or groups of needles in the total needle row, in order to minimize the length and expanse of the yarn tubes, as well as to facilitate threading and unthreading of each set of yarn feed rolls.

DESCRIPTION OF THE PREFERRED EMBODIMENT

Figure 1:
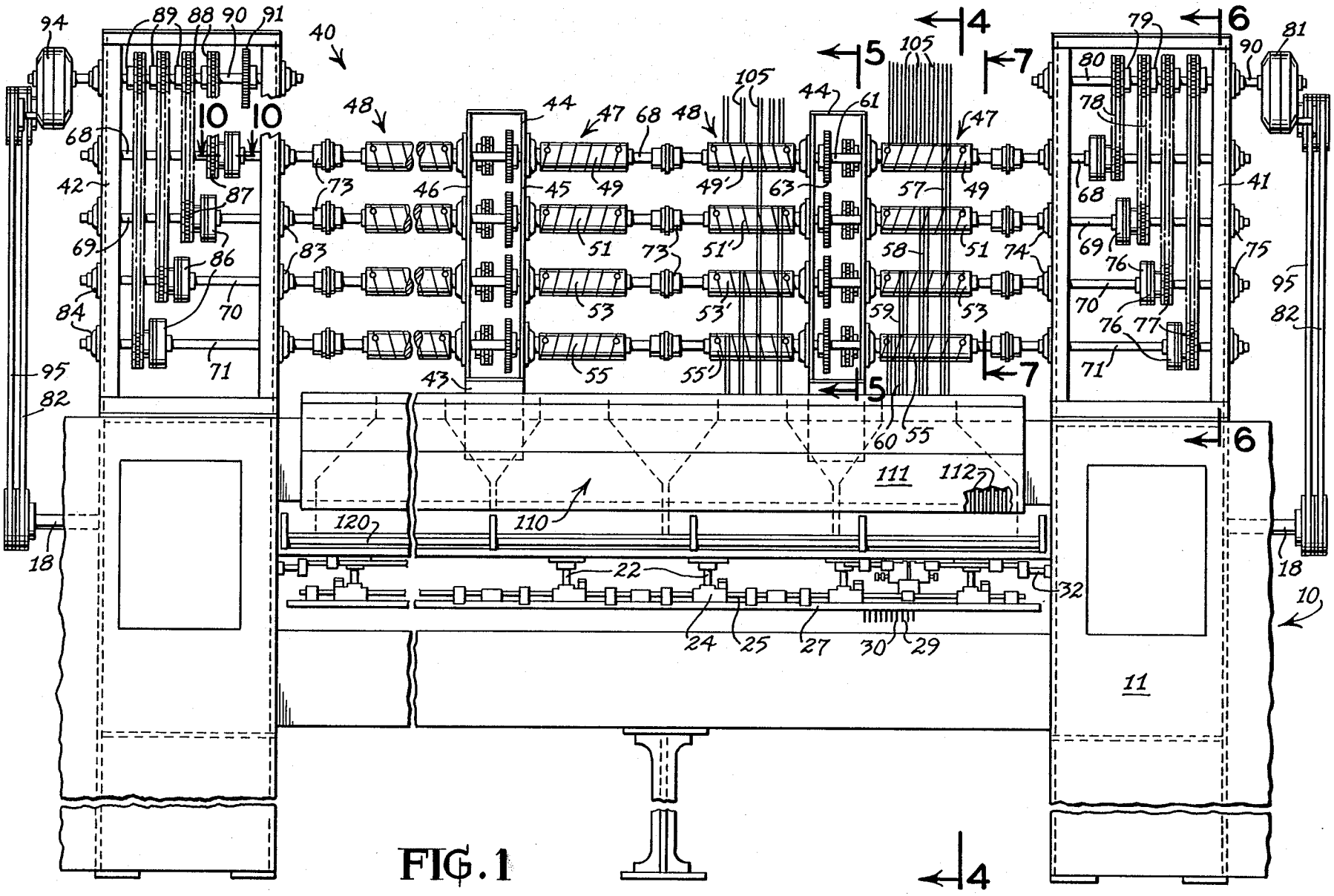
FIG. 1 is a front elevation of a multiple needle tufting machine incorporating the yarn feed mechanism made in accordance with this invention, with portions broken away.

Referring now to the drawings in more detail, FIGS. 1–4 disclose a multiple needle tufting machine 10 made in accordance with this invention. The machine 10 includes a housing 11 and a bed frame 12 upon which is mounted a needle plate 13 for supporting a base fabric 14 adapted to be moved through the machine 10 from front-to-rear in the direction of the arrow 15 by the front fabric rollers 16 and the rear fabric rollers 17.

A motor, not shown, drives a rotary main drive shaft 18, which is connected by linkage, not shown, for reciprocably rotating a needle rocker shaft 19 carrying rocker arms 20 pivotally connected through link arms 21 to vertically reciprocable push rods 22. The lower end of each push rod 22 is fixedly connected to an elongated needle bar slide holder or foot 24 by a pair of parallel slide-ways, not shown, reciprocably receiving elongated slide bars or rods, each of which is fixed to a respective front needle bar 27 and a rear needle bar 28. The front needle bar 27 supports a plurality of uniformly spaced front needles 29 preferably aligned along the longitudinal axis of the needle bar 27. The rear needle bar 28 supports a plurality of uniformly spaced rear needles 30, also preferably aligned along the longitudinal axis of the rear needle bar 28.

Figure 4:
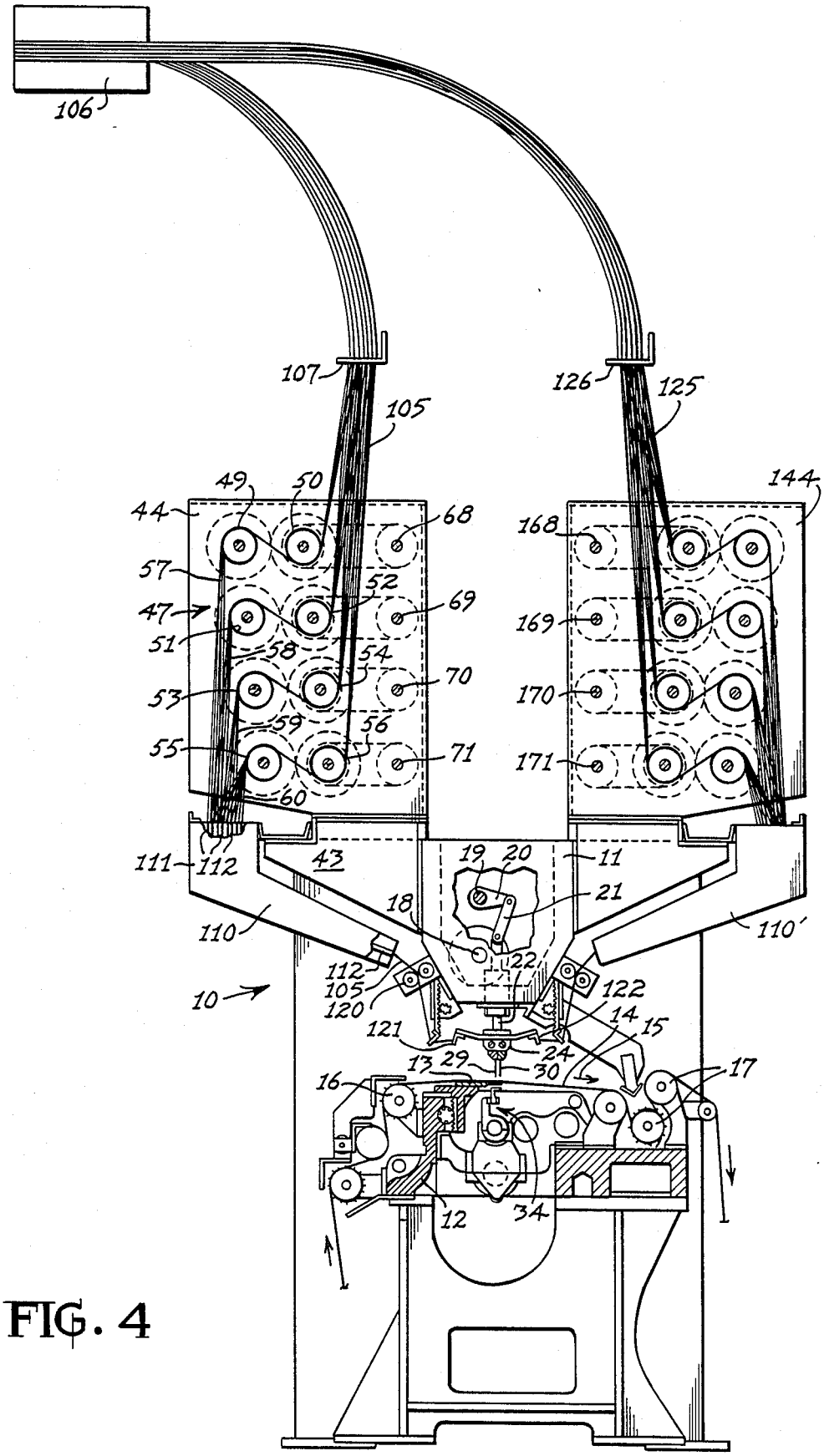
FIG. 4 is a sectional elevation taken along the line 4—4 of FIG. 1.
Figure 4A:
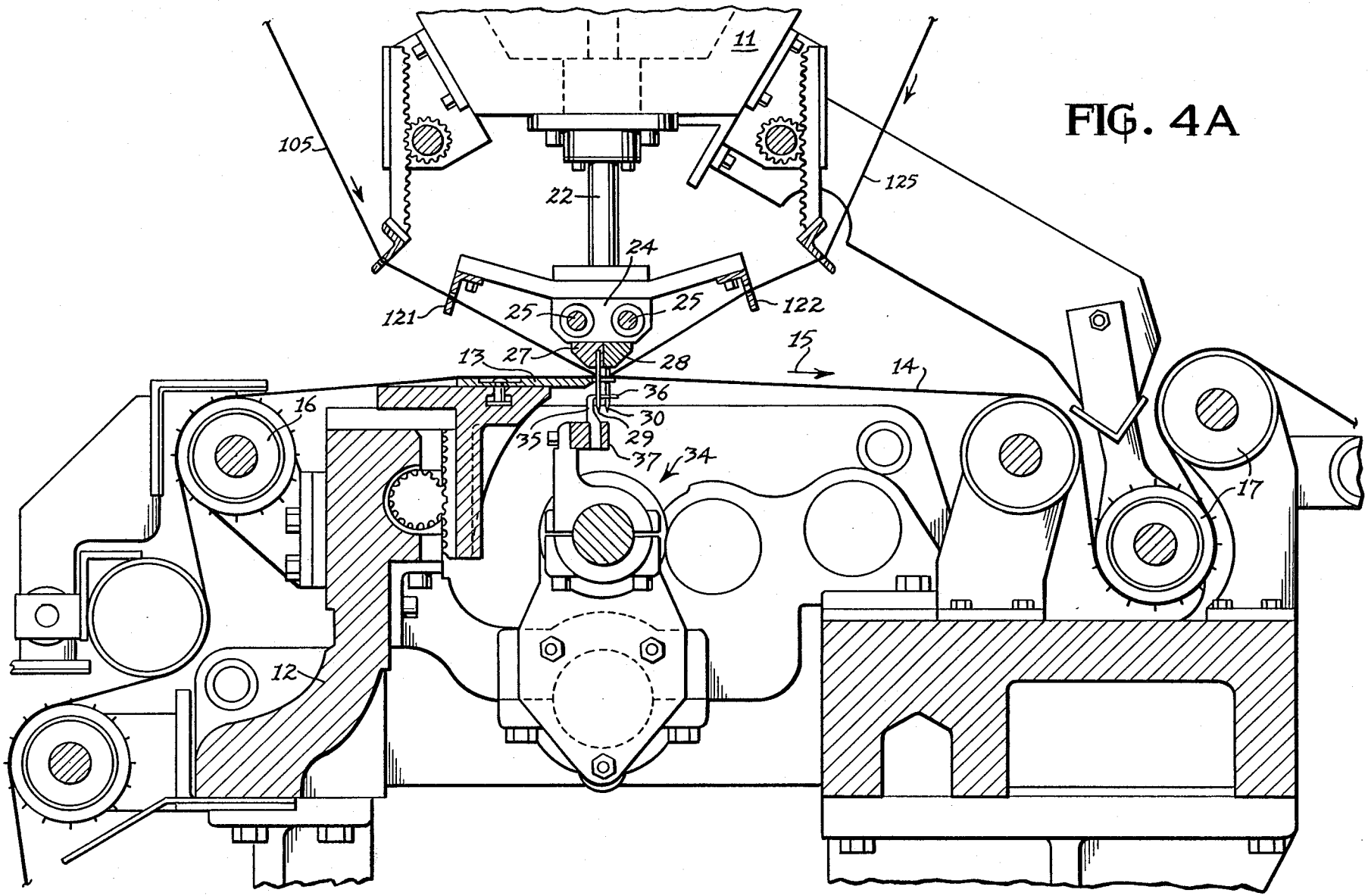
FIG. 4A is an enlarged fragmentary, sectional elevation of the lower portion of the machine disclosed in FIG. 4.

The looper mechanism 34 in FIG. 4 is of a known construction and includes a front looper 35 and a rear looper 36 to cooperate with each respective front and rear needle 29 and 30. The loopers 35 and 36 are mounted on a hook bar 37 and connected by linkage to the main drive shaft 18 for reciprocable motion synchronously with the needles in order to form front and rear transverse rows of loop pile tufts.

The needle bars 27 and 28 are each independently shiftable by shift rods, such as the shift rod 32, controlled by pattern control mechanisms, not shown, in the manner described in the R. T. Card, U.S. Pat. No. 4,366,761. Each of the front and rear needle bars 27 and 28 may be independently shifted in accordance with the predetermined pattern in order to form various types of geometric or graphic designs in the base fabric 14, in a well known manner.

In order to form high loop pile and low loop pile in accordance with the principle of backrobbing previously formed loops, as taught in U.S. Pat. No. 2,966,866, a pattern-controlled yarn feed mechanism 40 incorporating a plurality of yarn feed rolls adapted to be independently driven at different speeds has been designed for attachment to the machine housing 11.

Figure 2:
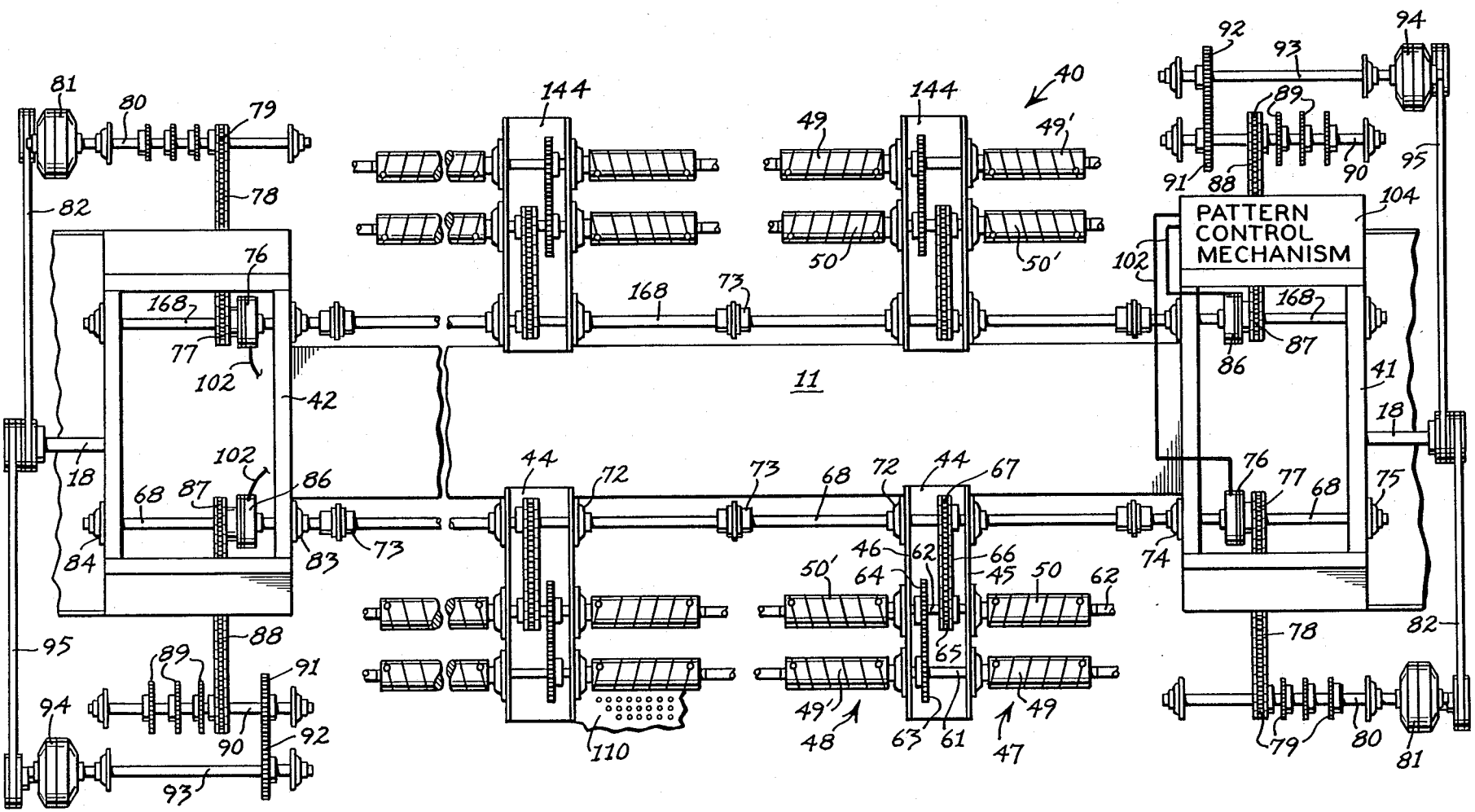
FIG. 2 is a top plan view of the tufting machine disclosed in FIG. 1, with portions broken away.

As best disclosed in FIGS. 1 and 2, a right clutch housing 41 and a left clutch housing 42 are mounted at each end of the machine 10 and supported in any convenient manner upon the top of the machine housing 11.

Mounted upon the front of the machine 10, by brackets 43 affixed to the upper portions of the machine housing 11, are a plurality of transversely spaced yarn feed supports or support housings 44. Each front support housing 44 includes a pair of transversely spaced side walls 45 and 46. Supported upon the exterior of the opposite side walls 45 and 46 are a right bank or set 47 of yarn feed rolls and a left bank or set 48 of yarn feed rolls, each yarn feed roll projecting outward away from its corresponding side wall 45 or 46 and terminating in a free unobstructed end.

As disclosed in the drawings, the right bank 47 includes a plurality of vertically spaced yarn feed stub rolls, such as the four pair of feed rolls 49, 50, 51, 52, 53, 54, 55, and 56. The yarn feed rolls in each pair 49–50, 51–52, 53–54, and 55–56 are preferably mounted parallel to each other in the same horizontal plane and spaced apart front-to-rear just sufficiently to provide an adequate wrap for each corresponding set of yarns, such as the yarn sets 57, 58, 59, and 60, as disclosed in FIG. 7.

The left bank 48 includes yarn feed rolls identical in size, number, and spacing to the yarn feed rolls in the right bank, and are identified by the same reference numerals with primes, such as yarn feed rolls 49′, 50′, 51′, 53′ and 55′. However, the left bank rolls, e.g. 49′, project from the common support 44 in the opposite direction from the right bank rolls, e.g. 49, and terminate in free, unobstructed ends. Moreover, the left bank feed rolls, e.g. 49′, are rotatably mounted in coaxial alignment with their corresponding yarn feed rolls, e.g. 49, in the right bank 47.

Moreover, in a preferred form of the invention, each of the corresponding yarn feed rolls on opposite side walls 45 and 46 are not only coaxially aligned, but are mounted on common driven roll shafts 61 and 62 (FIG. 2), which extend through the support housing 44 and are journaled in corresponding rotary bearings 63 and 64 on the opposite side walls 45 and 46. Thus, the top yarn feed roll 49 in the right bank 47 is fixed to and mounted upon the same roll shaft 61 as its coaxially aligned counterpart feed roll 49′ in the left bank 48. In the same manner, the top yarn feed roll 50 is mounted on the same common shaft 62 as its corresponding left top yarn feed roll 50′.

The corresponding pairs of yarn feed rolls in each bank 47 and 48, such as the top rolls 49, 50, 49′ and 50′, are mounted at the same elevation and are cooperatively connected together for simultaneous rotary motion at the same speed in opposite directions by transmissions, such as the cooperating reversing gears 63 and 64 fixed upon the corresponding common shafts 61 and 62, as illustrated in the drawings. Thus, all four yarn feed rolls at each level, such as the top yarn feed rolls 49, 50, 49′ and 50′; mounted on the same support housing 44, are all simultaneously driven at the same speed. However, yarn feed rolls at different levels may be driven at different speeds.

Fixedly attached to each common shaft 62 is a driven sprocket 65 coupled by a chain 66 to a drive sprocket 67. Each drive sprocket 67 is keyed to, or otherwise fixed to, a corresponding elongated yarn feed drive shaft 68, 69, 70, and 71. Each of the yarn feed drive shafts 69–71 extend through and are journaled for rotation in the rear portions of the front support housings 44. Moreover, the yarn feed drive shafts 68–71 may be formed in sections, as clearly disclosed in the drawings, so that each yarn feed drive shaft section is supported solely by the bearings 72 in the rear portion of a corresponding support housing 44. The yarn feed drive shaft sections are then joined together coaxially by the couplings 73.

The right end portion of each of the yarn feed drive shafts 68–71 extends through the inside wall of the right clutch housing 41 and is journaled in bearings 74 and is journaled in the exterior wall of the clutch housing 41 by bearings 75. The right end portion of each of the yarn feed drive shafts 68–71 carries a high-speed electromagnetic clutch 76 adapted to engage, when electrically energized, a driven sprocket 77 coupled by chain 78 to a drive sprocket 79 rigidly keyed upon a driven shaft 80 driven through a reduction gear 81 by a belt transmission 82 from the main drive shaft 18.

Figure 6:
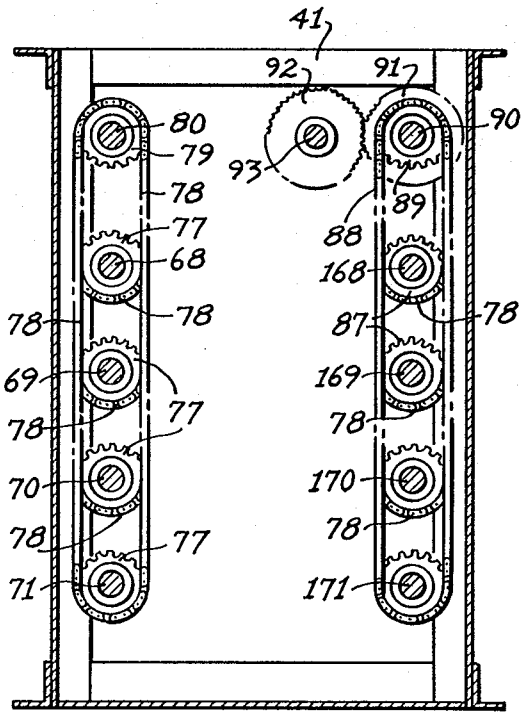
FIG. 6 is an enlarged fragmentary section taken along the line 6—6 of FIG. 1.
Figure 5:
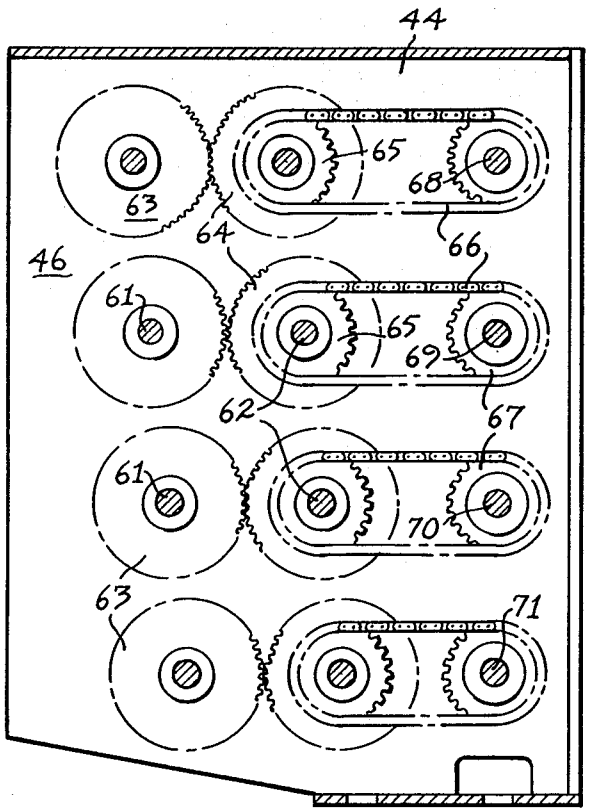
FIG. 5 is an enlarged fragmentary vertical section taken along the line 5—5 of FIG. 1.

As illustrated in FIG. 1, all of the right end portions of the yarn feed drive shaft 68–71 extend parallel to each other in a vertically spaced arrangement, and the driven shaft 80 with its drive sprockets 79 is also located vertically above the yarn feed drive shafts 68–71. This vertical arrangement of the driven shaft 80 and the yarn feed drive shafts 68–71 is also shown in FIG. 6. However, in FIG. 2, the driven shaft 80 with the drive sprockets 79 has been offset forward, merely for illustrative purposes in order to clarify the disclosure of the chain linkage between the driven shaft 80 and the yarn feed drive shafts 68–71.

In a similar manner, the left end portions of the yarn feed drive shafts 68–71 extend through the left clutch housing 42 and are journaled in the inside bearings 83 and the outside bearings 84. Each of the yarn feed drive shafts carries and cooperates with a low speed clutch 86, each of which is adapted to engage, when electrically energized, a driven sprocket 87, which in turn is linked through chain 88 to a drive sprocket 89 on a driven shaft 90. The driven shaft 90 is keyed to a gear 91 which meshes with a gear 92 fixed upon a reducer driven shaft 93 carrying a reducer mechanism 94, which in turn is coupled through the pulley and belt transmission 95 to the main drive shaft 18. The gears 91 and 92 are utilized to reverse the direction of the shaft 90, since the reduction gear 94 is a double reducer having a reverse direction from the reducer mechanism 81, so that the yarn feed drive shafts 68–71 are driven in the same direction from each end.

Figure 10:
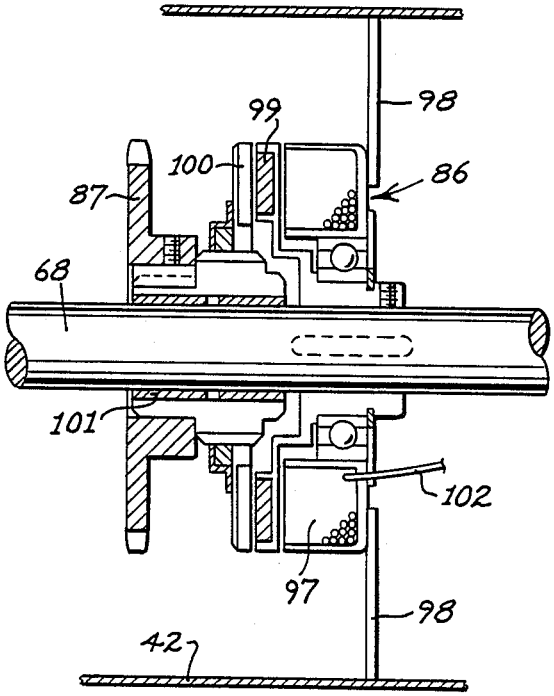
FIG. 10 is an enlarged fragmentary section taken along the line 10—10 of FIG. 1.

As illustrated in FIG. 10, each of the low speed electromagnetic clutches 86 includes an electromagnetic coil 97 which is held in a stationary position, such as by the support arms 98 fixed to the side walls of the clutch housing 42. Keyed to the shaft 68 is a rotary clutch member 99. The sprocket 87 is fixed to an annular armature 100 and a rotary bearing or bushing 101 which is free to rotate about the shaft 68. However, when the coil 97 is energized, the clutch member 99 engages the armature 100 to cause the sprocket 87 to rotate with the shaft 68. All of the low-speed electromagnetic clutches 86 and the high-speed clutches 76 are preferably identical. The electromagnetic coils 97 are connected through leads 102 to a conventional pattern control mechanism 104 which may be pre-programmed in any desired manner, in order to selectively energize certain high-speed and low-speed clutches, which in turn drive the yarn feed rolls 49–56 at desired speeds, either high speed or low speed. The speeds of the yarn feed drive shafts is determined by the diameters of the sprockets 77 and 87.

However, the pattern control mechanism 104 is so programmed that only the high speed clutch 76, or a low speed clutch 86 will drive any particular yarn feed drive shaft 68–71. The pattern control mechanism 104 may be of any desired construction, such as that disclosed in either of the J. L. Card U.S. Pat. Nos. 2,966,866 or 2,862,465, or in the Hammel U.S. Pat. No. 3,847,098, or any more sophisticated pattern control mechanisms currently used.

Figure 7:
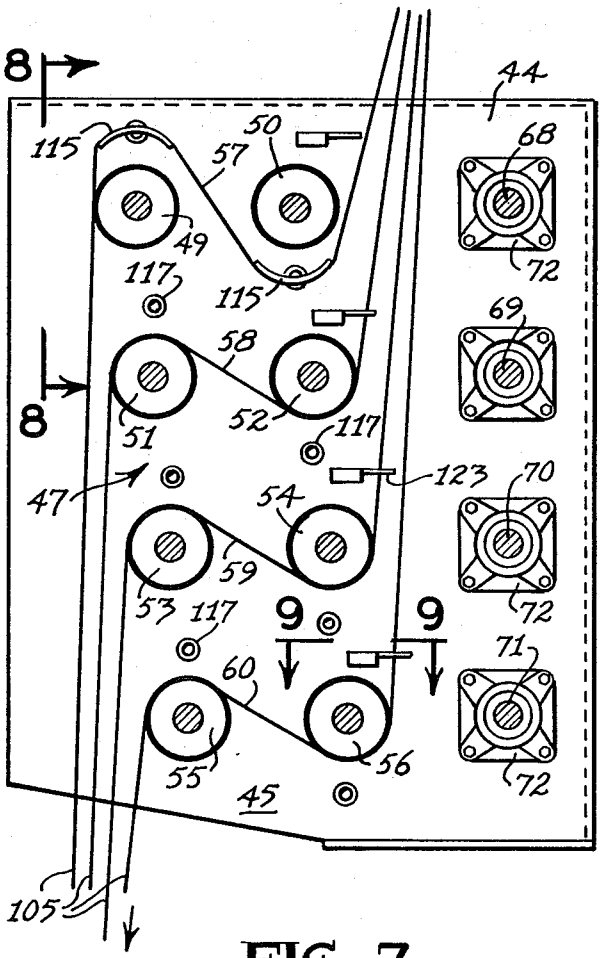
FIG. 7 is an enlarged section taken along the line 7—7 of FIG. 1 with some of the yarn shields in place for the top yarn feed rolls.

As disclosed in FIGS. 1, 4, and 7, a plurality of front yarns 105 are fed from a yarn supply 106, such as a creel, and are fed through upper yarn guides 107 in separate sets to each bank of yarn feed rolls on the right and left sides of each support housing 44. In each bank of yarn feed rolls, each set of yarns is threaded about a corresponding pair of cooperating yarn feed rolls, such as the pair 49–50, or 53–54, as illustrated in FIGS. 4 and 7. Each set of yarns 105 is wrapped around the bottom of the rear yarn feed rolls 50, 52, 54, and 56, and then wrapped around the upper surface of the front yarn feed rolls in each pair, namely, the yarn feed rolls 49, 51, 53, and 55, (FIG. 7).

The yarns 105 from all four sets of yarns in each bank are then fed through a separate yarn feed tube bank 110, each of which includes a separate housing 111 and a plurality of yarn guide tubes 112. The upper ends of each of the yarn guide tubes 112 are mounted in the top of the housing 111 in a plurality of transverse rows (FIG. 2), while the lower ends of the tubes 112 are mounted in a lesser number of rows, such as one or two rows, over a greater transverse expanse than the upper ends of the tubes. In other words, looking at the yarn tube banks 110 from the front or rear, the yarn tubes 112 fan out transversely in opposite directions.

However, each of the yarn tube banks 110 carries the yarns only from a single vertical bank of yarn feed rolls so that the transverse expanse of the yarn feed is only a small portion of the entire width of the machine 10 and serves only a small group of transversely spaced needles 29 in the entire needle row. Thus, as illustrated in FIG. 1, there are six yarn tube banks 110, one tube bank for each of the six vertical banks of yarn feed rolls.

The structure of the yarn tube banks 110, including the housing 111 and the yarn tubes 112 is substantially the same as those disclosed in the J. L. Card U.S. Pat. No. 2,862,465 or the Hammel U.S. Pat. No. 3,847,098, except that the yarn tube banks 110 are substantially shorter so that they extend only a fraction of the entire width of the machine, as opposed to the full width expanse of the yarn tube banks in the above prior patents.

It will be further observed in FIGS. 1 and 2, that there is substantial spacing between the adjacent free ends of the yarn feed rolls in adjacent banks 47 and 48 on adjacent yarn support housings 44. Thus, because of the shorter yarn feed stub rolls 49–56 in the plurality of yarn feed banks, the free ends of the rolls, and the spacing between the free ends of the rolls, the threading of each tube bank 110 is considerably easier than it is for longer yarn feed rolls, particularly those which extend substantially the full width of the machine 10. The spacing between the free ends of the yarn feed rolls should be great enough that an operator may get his hand between the opposed feed rolls in order to withdraw the yarns in each set of rows axially from the free end of rolls and then to re-insert other yarns longitudinally or coaxially along the yarn feed rolls in order to change the patterns to be formed in the base fabric 14. As disclosed in the drawings, the spacing between the free ends of adjacent feed rolls is approximately equal to the length of each yarn feed stub roll.

In threading yarn feed rolls, the integrity of the front yarns 105 remains throughout the threading and unthreading process. In other words, the yarns are not cut between the front needles 29 and the yarn supply 106. The yarns are merely slipped coaxially off of the feed rolls and re-inserted and wrapped about the feed rolls in different configurations. For example, after one set of yarns is removed from the top feed rolls 49 and 50, some of the yarns from a lower set of feed rolls, such as 53 and 54 may be combined with yarns from other sets and re-threaded or wrapped upon the top feed rolls 49 and 50. Such re-threading of the yarns of all four pairs of the yarn feed rolls in each bank may be conducted in the same manner.

Figure 8:
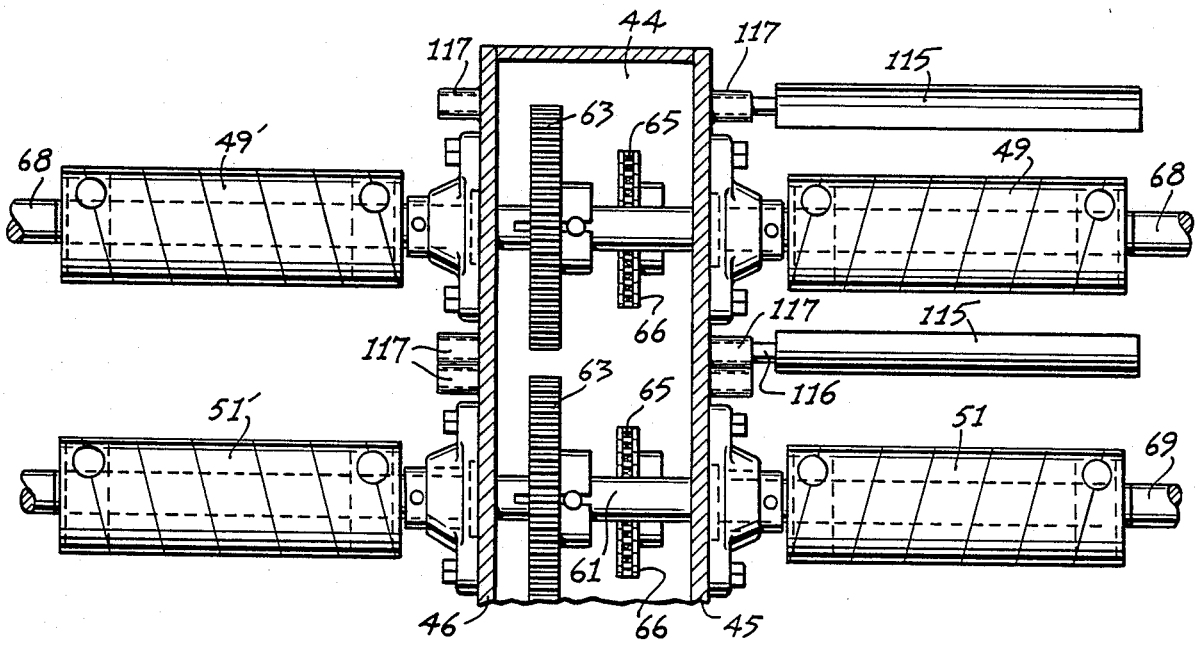
FIG. 8 is an enlarged section taken along the line 8—8 of FIG. 7.

In order to facilitate the threading and unthreading of the yarn feed rolls, yarn shields 115, such as those disclosed in FIGS. 7 and 8, may be inserted in spaced relationship to the rolls in order to hold the yarns which have been removed from the feed rolls until they are needed for re-threading the same or other feed rolls.

Each of the yarn shields 115 is preferably an elongated piece of sheet material having an arcuate cross-section and about the same length as the corresponding feed roll. The inner end of each shield 115 is provided with an elongated coaxial support rod 116 which may be slip-fit into a corresponding tubular socket 117 formed on the outer surface of a side wall 45 and 46 of the corresponding yarn feed support housings 44. There will be one socket 117 for each yarn feed roll. As illustrated in FIG. 7, the rear sockets 117 are spaced vertically below the axis of the corresponding rear yarn feed rolls 50, 52, 54, and 56, while the front tubular support sockets 117 are mounted vertically above the axes of the front yarn feed rolls 49, 51, 53, and 55. The shields 115 are mounted concave toward the respective feed rolls, so that yarns 105 removed from a feed roll and located on a corresponding shield 115 have the same curvature of wrap as they do when mounted on the feed roll.

In removing yarns, such as 105, from a yarn feed roll, such as 49, the yarn shield 115 is manually moved axially, support rod 116 first, beneath the top set of yarns 57 and between the yarns 57 and the yarn feed roller 49. After the shield 115 has been moved toward the support housing 44 far enough that all of the yarns 57 engage the shield 115, the shield 115 is raised or moved radially away from the yarn feed roll 49 until the support rod 116 registers with its corresponding socket 117. The support rod 116 is then inserted into its socket 117 to hold the shield 115 in its operative position, disclosed in FIGS. 7 and 8, to support the yarns 57 on the shield 115 above the yarn feed roll 49. Since the surface of the shield 115 has a low coefficient of friction relative to the frictional surface of the yarn feed roll, the yarns 57 may easily be slipped axially off the free end of the yarn shield 115. After a different set of yarns 57 is selected for the yarn feed roll 49, the yarns are slid axially one-by-one along the shield 115 toward the housing 44, until they are all in place on the shield 115. The shield 115 is then moved axially away from the support housing 44 to withdraw the support rod 116 from its socket 117 and permit all the yarns 57 to slip off the shield 115 and lie wrapped about the corresponding yarn feed roll 49.

It will be noted in FIG. 7, that two of the yarn shields 115 have been inserted in their respective sockets 117. One shield 115 has been placed above the top feed roll 49 and the other shield has been placed below the top yarn feed roll 50 to facilitate the threading and unthreading of this pair of rolls. The yarn shields 115 have been removed from the other sockets 117 for the three lower pairs of feed rolls 51–52, 53–54, and 55–56, and the yarns 105 are wrapped around these respective feed rolls in position for feeding to the front needles 29.

The front yarns 105 leaving the bottom of the yarn tube banks 110 are guided in a conventional manner through the yarn puller rollers 120, and the yarn guides 121 and 122 to the front needles 29 (FIG. 4).

Figure 9:
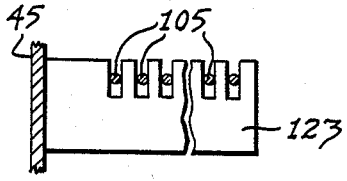
FIG. 9 is an enlarged fragmentary plan section taken along the line 9—9 of FIG. 7.

As best disclosed in FIGS. 7 and 9, a plurality of conventional yarn comb guides 123 may be mounted in the side walls 45 and 46 of the support housings 44 to guide the individual yarns 105 from the yarn supply 106 to the individual yarn feed rolls 50, 52, 54, and 56.

Figure 3:
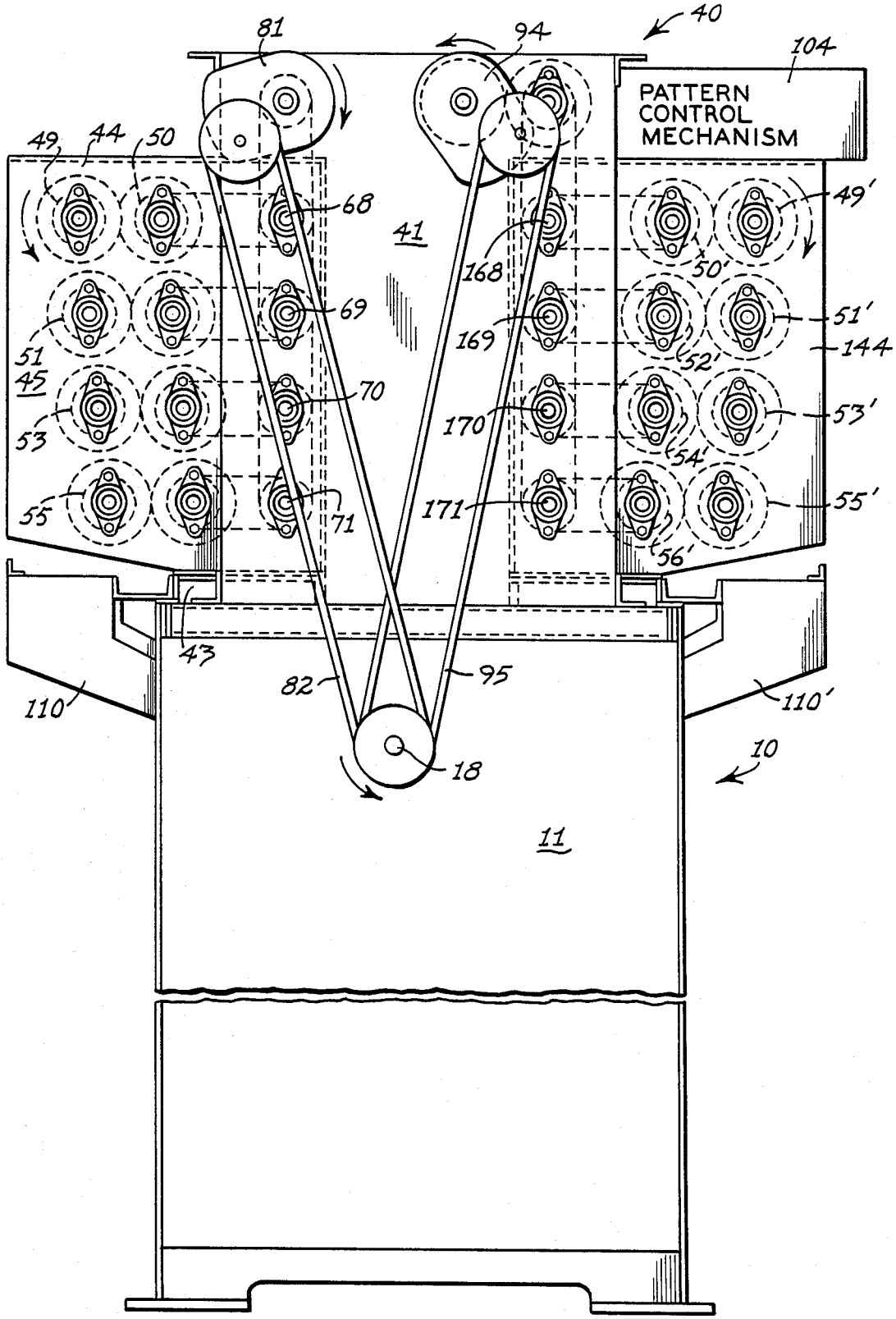
FIG. 3 is a right end view of the tufting machine disclosed in FIG. 1.

In the drawings, and particularly FIGS. 2, 3, and 4, a plurality of sets of rear yarns 125 may be fed through the upper yarn guides 126 to identical banks of yarn feed rolls 49–56 and 49'–56' as those on the front of the machine. The rear yarn feed rolls are mounted on rear yarn drive housings 144, which are identical to the front housings 44. The yarn feed rolls are driven by a plurality of vertically arranged yarn feed drive shafts 168, 169, 170, and 171, the opposite ends of which are journaled in the respective right and left clutch housings 41 and 42 and are driven through identical clutches to move each drive shaft at either a high or low speed. However, in the right clutch housing 41, each rear drive shaft, such as drive shaft 168, supports a low speed clutch 86, while the opposite end of each rear shaft in the left clutch housing 42 supports a high speed clutch 76. The clutches are adapted to be energized to selectively engage the corresponding driven sprockets, such as 77 and 87, and are driven from the main shaft 18 through sprocket and chain transmission and reduction gears of the same construction as their counterparts on the front of the machine 10.

The rear yarns 125 are fed through the respective rear yarn feed rolls in the same manner as the yarns 105 on the front of the machine and extend through identical yarn tube guides 110' on the rear of the machine and through corresponding yarn guides to the respective rear needles 30. The spacing between the yarn feed rolls on the rear of the machine is the same as those on the front of the machine to facilitate threading of the rear yarn feed rolls in the same manner as the threading of the front yarn feed rolls.

In the operation of the machine, various yarns 105 and 125 are threaded in sets about their corresponding banks of pairs of yarn feed rolls 49–56. In one example approximately 135 front yarns 105 are threaded over the eight feed rolls in each bank 47 and 48. Where six banks are used, approximately 810 front needles 29 are served by corresponding yarns to form six transverse repeat patterns.

The pattern control mechanism 104 is programmed in accordance with the desired pattern. After the machine 10 is started, the main drive shaft 18 simultaneously drives all of the corresponding elements in the same manner as the corresponding parts in any known tufting machine, such as the reciprocation of the needles 29 and 30 and their cooperating loopers 35 and 36.

All of the yarn feed drive shafts 68–71 and 168–171 are simultaneously driven through the pattern-controlled clutches 76 and 86 mounted in the clutch housing 41 and 42 at the ends of the machine so that all yarn feed rolls are simultaneously driven to feed yarn to the corresponding needles. The high or low pile tufts formed in the base fabric 14 are determined by the speed of the corresponding yarn feed rolls feeding the corresponding yarns, which are, in turn, controlled by the selective energization of the high and low speed clutches from the pattern control mechanism 104. If desired, the needle bars 27 and 28 are transversely shifted or remain stationary in accordance with the pattern drive controlling these needle bars, not shown, but as carried out in the prior U.S. Pat. No. 4,366,761.

The tufted loops formed in the base fabric 14 as it moves through the machine 10 will form geometric or graphic patterns even more varied than those disclosed in the prior U.S. J. L. Card Pat. No. 2,966,866, because of the multiple yarn feed rolls in combination with the dual shiftable needle bars.

It is also within the scope of this invention to use a single row of transversely spaced needles which are fixed with respect to a non-shiftable needle bar, and to utilize only the front yarn feed rolls, supports and clutch housings illustrated on the front of this machine 10. In other words, all of the rear supports and feed rolls, and their drives, would be removed in such a modification. In this event, patterns in high and low loop pile fabrics will be somewhat similar to those disclosed in the prior J. L. Card U.S. Pat. No. 2,966,866. However, when it is desired to change the patterns by rearranging the mix of the yarns in each set controlled by the different pairs of yarn feed rolls, such unthreading and rethreading can be accomplished in a fraction of the time which would be required for the threading and unthreading of rolls in the prior J. L. Card U.S. Pat. No. 2,966,866.

When it is desired to change the arrangement of the yarns, the machine is stopped, the operator merely places his hands between the free ends of adjacent yarn feed rolls and begins stripping the yarns coaxially of the yarn feed rolls away from their corresponding support housings and off the free ends. When the shields 115 are used, the shields 115 are first inserted between the yarns and the feed rolls engaging the yarns, and then into their corresponding sockets 117 in positions such as those disclosed in FIG. 7. The yarns remain stored on the arcuate shields 115 until they are needed again in rethreading the machine. In rethreading, yarns are slipped axially over the free ends of their corresponding shields, and the shields 115 are removed to permit the yarns to engage their corresponding feed rolls in new wrapped positions to establish the new patterns in the base fabric 14.

It is also within the scope of this invention to utilize other numbers of yarn feed rolls in each bank, such as a six-roll bank, a seven-roll, or even a nine-roll bank. It is also possible to utilize a two-roll bank, that is a bank in which there are two vertically spaced yarn feed rolls, and each roll cooperates through their reversing gears with another yarn roll, so that there are actually four instead of two rolls. Thus, in each bank disclosed in FIGS. 1, 2, and 7, these banks are referred to as four-roll banks, even though each bank includes eight or four pairs of rolls.

What is claimed is:

1. In a multiple needle tufting machine having means for feeding a base fabric longitudinally from front-to-rear through the machine, and a longitudinal row of predetermined length of a plurality of spaced needles aligned transversely of the machine for reciprocable movement through the base fabric, a yarn feed mechanism comprising:

(a) a yarn feed support mounted on said machine and having opposite sides, (b) a plurality of spaced parallel yarn feed rolls mounted on one of said sides for rotation about corresponding transverse axes, (c) each of said feed rolls having a driven end journaled on said side of said yarn feed support and having an opposite unsupported free end projecting away from said support, (d) each of said yarn feed rolls having a length substantially less than the predetermined length of said row of transversely aligned needles, (e) yarn guide means for said yarn feed rolls, having means for guiding each yarn from each of said yarn feed rolls to a needle in said longitudinal row, (f) a yarn feed drive shaft operatively connected to each of said yarn feed rolls for driving said yarn feed rolls, (g) high-speed drive means operatively connected to each of said yarn feed drive shafts for selectively driving each of said drive shafts at a predetermined high speed, (h) low-speed drive means operatively connected to each of said yarn feed drive shafts for driving each of said drive shafts at a predetermined low speed, and (i) pattern control means operatively connected to said high-speed drive means and to said low-speed drive means whereby only one of said speed drive means operatively drives any one of said yarn feed rolls at any one time, so that any of said yarn feed rolls is driven at said high speed or said low speed.

2. The invention according to claim 1 in which said yarn feed support comprises a plurality of yarn feed supports spaced transversely of said machine, each of said supports having its yarn feed rolls projecting from one side of said support, each of said free ends being transversely spaced from any other yarn feed roll or yarn feed support substantially far enough to permit threading and unthreading of each of said yarn feed rolls.

3. The invention according to claim 2 in which the yarn feed rolls on an adjacent pair of yarn feed supports project toward each other.

4. The invention according to claim 3 in which said opposite sides of each of said feed supports comprises first and second sides and further comprising a first set of a plurality of said yarn feed rolls mounted on said first side of each of said yarn feed supports and a second set of said yarn feed rolls mounted on said second side of each of said yarn feed supports, said free ends of said yarn feed rolls in said first and second sets projecting in opposite directions away from said corresponding yarn feed support, said spacing between said free ends of adjacent feed rolls in said first and second sets on adjacent yarn feed supports being substantially great enough to permit threading and unthreading of each of said yarn feed rolls in said first and second sets.

5. The invention according to claim 4 in which each of said yarn feed drive shafts extend transversely substantially the full width of said machine and adjacent each of said yarn feed supports, and transmission means for drivingly connecting each of said yarn feed drive shafts to the driven end of each of said yarn feed rolls.

6. The invention according to claim 5 in which said yarn feed rolls in each of said first and second sets are equal in number and equal to the number of said yarn feed drive shafts.

7. The invention according to claim 6 in which each of said yarn feed rolls in said first set is coaxially aligned with a yarn feed roll in said second set to define an aligned pair of drive feed rolls projecting in opposite directions from said support, said transmission means comprising a separate transmission means drivingly connecting each of said yarn feed drive shafts to a corresponding pair of aligned yarn feed rolls.

8. The invention according to claim 7 in which said transmission means couple said yarn feed drive shafts to corresponding yarn feed rolls on each of said supports for driving all of said yarn feed rolls selectively at said high and low speeds.

9. The invention according to claim 8 in which the spacing between the free ends of said yarn feed rolls on adjacent supports is substantially equal to the length of each of said feed rolls.

10. The invention according to claim 9 in which each of said yarn feed drive shafts has opposite end portions, said high speed drive means being operatively connected to one of said end portions and said low speed drive means being operatively connected to the opposite end portions of said corresponding yarn feed drive shafts.

11. The invention according to claim 10 in which each of said high speed drive means and said low speed drive means comprises electromagnetic clutch means operatively connected to said corresponding yarn feed drive shafts.

12. The invention according to claim 5 in which said yarn feed drive shafts are vertically spaced, said yarn feed rolls are vertically spaced in said first set and said yarn feed rolls are vertically spaced in said second set, each yarn feed roll in said first set being coaxially aligned with a yarn feed roll in said second set to form a coaxial pair and each of said pair of yarn feed rolls being substantially at the same level as a corresponding yarn feed drive shaft.

13. The invention according to claim 12 in which said transmission means comprises a common driven shaft coaxial with each said coaxial pair of yarn feed rolls, a drive sprocket on said corresponding drive shaft and a driven sprocket on said corresponding common shaft and a chain coupling said corresponding drive and driven sprockets.

14. The invention according to claim 13 further comprising a tension feed roll for each of said yarn feed rolls parallel to said corresponding yarn feed roll and further comprising gear transmission means linking each yarn tension roll with its corresponding yarn feed roll for cooperative rotation.

15. The invention according to claim 14 further comprising an elongated arcuate yarn shield fixed on said support and extending substantially parallel to and spaced from a yarn feed roll for supporting a yarn stripped from said yarn feed roll normally guided around said yarn feed roll, said shield having a free end opposite said support.

16. The invention according to claim 4 in which said yarn guide means comprises a first yarn guide means for said first set of yarn feed rolls and a second yarn guide means for said second set of yarn feed rolls, said first yarn guide means having means for guiding yarns from said first set of rolls to a first section of a plurality of aligned needles in said row, said second yarn guide means guiding yarns from said second set of yarn feed rolls to a second section of aligned needles adjacent said first section of aligned needles.

17. The invention according to claim 4 further comprising a pair of elongated, parallel, transversely extending, slidable needle bars, each of said needle bars supporting a plurality of aligned needles to define a front row of needles and a rear row of needles, said yarn feed supports comprising a plurality of transversely spaced front supports and a plurality of transversely spaced rear supports, each of said supports carrying first and second sets of said transversely extending yarn feed rolls having free ends spaced apart from each other, said yarn feed rolls on said front supports supplying yarn to said front needles and said yarn feed rolls on said rear support supplying yarns to said rear needles.

* * * * *